US009777682B2

(12) United States Patent
Preston et al.

(10) Patent No.: US 9,777,682 B2
(45) Date of Patent: Oct. 3, 2017

(54) FUEL TANK ASSEMBLY HAVING CROSSOVER TUBE

(71) Applicant: Honda Motor Co., Ltd., Minato-ku, Tokyo (JP)

(72) Inventors: Ryan David Preston, Hilliard, OH (US); Masaru Tomimatsu, Dublin, OH (US)

(73) Assignee: Honda Motor Co., LTD, Tokyo (JP)

( * ) Notice: Subject to any disclaimer, the term of this patent is extended or adjusted under 35 U.S.C. 154(b) by 514 days.

(21) Appl. No.: 14/553,041

(22) Filed: Nov. 25, 2014

(65) Prior Publication Data

US 2016/0146168 A1 May 26, 2016

(51) Int. Cl.
*F02M 37/00* (2006.01)
*F02M 37/02* (2006.01)
*F02M 37/10* (2006.01)

(52) U.S. Cl.
CPC .... *F02M 37/0017* (2013.01); *F02M 37/0088* (2013.01); *F02M 37/025* (2013.01); *F02M 37/10* (2013.01)

(58) Field of Classification Search
USPC ..... 180/314
See application file for complete search history.

(56) References Cited

U.S. PATENT DOCUMENTS 3,254,697 A 6/1966 Parks
3,884,255 A 5/1975 Merkle
5,360,034 A 11/1994 Der Manuelian
5,398,655 A 3/1995 Tuckey
5,983,932 A 11/1999 Wagner et al.
6,457,459 B1 10/2002 Schelhas et al.
(Continued)

FOREIGN PATENT DOCUMENTS

DE 10 2004 007 718 A1 10/2005
JP 3552270 B2 8/2004
(Continued)

OTHER PUBLICATIONS

Fuel System Description for 2005 Chevrolet Corvette, Document ID No. 1527496; retrieved on Sep. 5, 2013, from http://www.corvetteactioncenter.com/kb/questions/442/2003+-+2004%A+Service+information%3A+Fuel+Tank+System; 11 pages.
(Continued)

*Primary Examiner* — Karen Beck
(74) *Attorney, Agent, or Firm* — Arent Fox LLP

(57) ABSTRACT

A fuel tank assembly includes a primary fuel tank, a secondary fuel tank, a crossover tube, a fuel pump, a transfer tube, and a jet pump. The crossover tube is fluidly coupled with each of the primary fuel tank and the secondary fuel tank and defines a flow path for fuel to flow between the primary fuel tank and the secondary fuel. The fuel pump is disposed within the primary fuel tank and is configured to selectively supply fuel from the primary fuel tank to an engine. The transfer tube is routed internal to the crossover tube and is in fluid communication with each of the primary fuel tank and the secondary fuel tank. The jet pump is in fluid communication with the transfer tube and is configured to facilitate the flow of pressurized fuel from the secondary fuel tank, through the transfer tube, and into the primary fuel tank.

20 Claims, 7 Drawing Sheets

(56) References Cited

U.S. PATENT DOCUMENTS

| | | | | |
|---|---|---|---|---|
| 6,508,265 | B1 | 1/2003 | Bertouille et al. | |
| 6,782,916 | B2 | 8/2004 | Svendsen et al. | |
| 6,907,899 | B2 | 6/2005 | Yu et al. | |
| 7,007,675 | B2 | 3/2006 | Ida et al. | |
| 7,216,633 | B2 | 5/2007 | Attwood et al. | |
| 7,328,687 | B2 | 2/2008 | Kojima | |
| 8,230,841 | B2 | 7/2012 | Okada et al. | |
| 8,256,457 | B2 | 9/2012 | Bleuel | |
| 2010/0242923 | A1* | 9/2010 | Okada | F02M 37/0029 123/511 |
| 2011/0297260 | A1* | 12/2011 | Mason | F04F 5/10 137/565.29 |
| 2012/0000568 | A1* | 1/2012 | Schultz, Jr. | F16L 29/04 141/1 |
| 2012/0204984 | A1 | 8/2012 | Gebert | |

FOREIGN PATENT DOCUMENTS

| | | | |
|---|---|---|---|
| JP | 4225240 | B2 | 2/2009 |
| JP | 2009-215959 | A | 9/2009 |
| JP | 2009-221917 | A | 10/2009 |
| JP | 2013-507565 | A | 3/2013 |

OTHER PUBLICATIONS

GM Parts East; Parts List for 1997 Chevrolet Corvette, Section 03—Fuel System, Exhaust, Carburetion Emissions; Component 6. 1997-1999 Y, Fuel Tank, & Mounting—1Y03101, Component 3. 1997-1998 Y, Fuel Supply System—1Y03033, and Component 4. 1997-1998 Y, Fuel Supply System—1Y03103; retrieved on Sep. 5, 2013; 3 pages.

* cited by examiner

FUEL TANK ASSEMBLY HAVING CROSSOVER TUBE

TECHNICAL FIELD

A vehicle includes a fuel tank assembly having a primary fuel tank, a secondary fuel tank, and a crossover tube in fluid communication with each of the primary fuel tank and the secondary fuel tank. A transfer tube is routed through the crossover tube and provides pressurized fuel from the secondary fuel tank to the primary fuel tank.

BACKGROUND

Some conventional fuel tank assemblies include a pair of fuel tanks and a crossover tube. A plurality of transfer tubes are routed through the crossover tube and distribute pressurized fuel between the fuel tanks.

SUMMARY

In accordance with one embodiment, a vehicle comprises an engine, a primary fuel tank, a secondary fuel tank, a crossover tube, a fuel pump, a transfer tube, and a jet pump. The crossover tube defines a passageway and has an inner diameter. The crossover tube is fluidly coupled with each of the primary fuel tank and the secondary fuel tank. The fuel pump is disposed within the primary fuel tank and is in fluid communication with the engine for selectively supplying fuel from the primary fuel tank to the engine. The transfer tube comprises an extracting portion, a dispensing portion, and a central portion in fluid communication with each of the extracting portion and the dispensing portion. The central portion has an outer diameter and is routed internal to the crossover tube. The jet pump is in fluid communication with the transfer tube. An end of the extracting portion of the transfer tube is disposed in, and is in fluid communication with, the secondary fuel tank. An end of the dispensing portion of the transfer tube is disposed in, and is in fluid communication with, the primary fuel tank. The jet pump facilitates pumping of fuel from the secondary fuel tank, into the extracting portion, through the central portion, and out of the dispensing portion, and to the primary fuel tank. The central portion of the transfer tube and the crossover tube are substantially concentric at one end of the crossover tube.

In accordance with another embodiment, a fuel tank assembly comprises a primary fuel tank, a secondary fuel tank, a crossover tube, a fuel pump, a transfer tube, and a jet pump. The crossover tube is fluidly coupled with each of the primary fuel tank and the secondary fuel tank and defines a flow path for fuel to flow between the primary fuel tank and the secondary fuel tank at a first pressure. The fuel pump is disposed within the primary fuel tank and is configured to selectively supply fuel from the primary fuel tank to an engine. The transfer tube is routed internal to the crossover tube and is in fluid communication with each of the primary fuel tank and the secondary fuel tank. The jet pump is in fluid communication with the transfer tube and is configured to facilitate the flow of pressurized fuel at a second pressure from the secondary fuel tank, through the transfer tube, and into the primary fuel tank. The second pressure is greater than the first pressure. The transfer tube provides the only path through the crossover tube for fuel to flow from the secondary fuel tank to the primary fuel tank at a pressure greater than the first pressure.

In accordance with yet another embodiment, a vehicle comprises an engine, a primary fuel tank, a secondary fuel tank, a crossover tube, a fuel pump, a transfer tube, and a jet pump. The crossover tube is fluidly coupled with each of the primary fuel tank and the secondary fuel tank and defines a flow path for fuel to flow between the primary fuel tank and the secondary fuel tank at a first pressure. The fuel pump is disposed within the primary fuel tank and is configured to selectively supply fuel from the primary fuel tank to the engine. The transfer tube is routed internal to the crossover tube and is in fluid communication with each of the primary fuel tank and the secondary fuel tank. The jet pump is in fluid communication with the transfer tube and is configured to facilitate the flow of pressurized fuel at a second pressure from the secondary fuel tank, through the transfer tube, and into the primary fuel tank. The second pressure is greater than the first pressure. The transfer tube provides the only path through the crossover tube for fuel to flow from the secondary fuel tank to the primary fuel tank at a pressure greater than the first pressure.

BRIEF DESCRIPTION OF THE DRAWINGS

It is believed that certain embodiments will be better understood from the following description taken in conjunction with the accompanying drawings in which.

DETAILED DESCRIPTION

Figure 1:
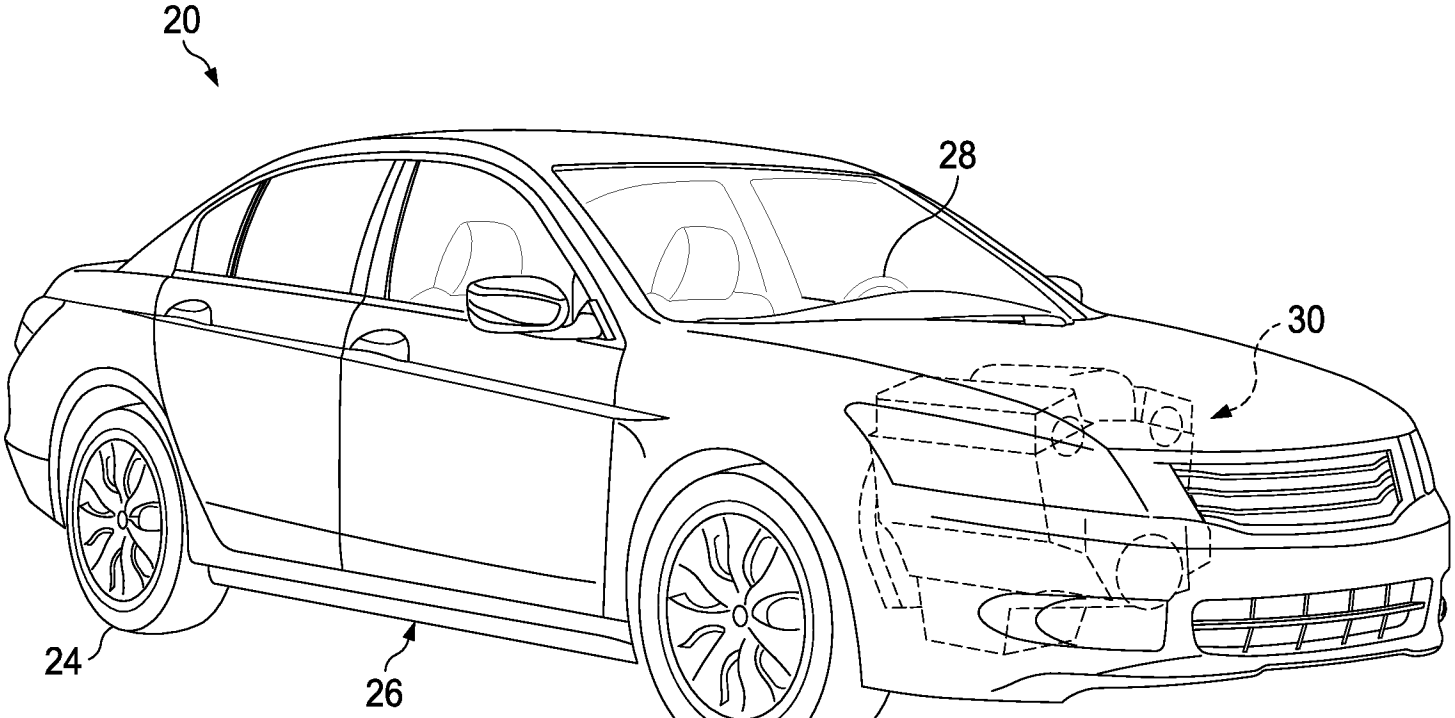
FIG. 1 is a front perspective view depicting a vehicle, wherein certain hidden components are shown in dashed lines.

In connection with the views and examples of FIGS. 1-8, wherein like numbers indicate the same or corresponding elements throughout the views, FIG. 1 illustrates a vehicle 20. The vehicle 20 is shown in FIG. 1 to comprise an automobile. However, a vehicle in accordance with alternative embodiments can comprise a sport-utility vehicle ("SUV"), a truck, a van, a cross-over type vehicle ("CUV"), or any of a variety of other suitable vehicles, such as a recreational vehicle or a utility vehicle, for example. As illustrated in FIG. 1, the vehicle 20 can comprise front wheels 22 and the rear wheels 24 that are rotatably supported with respect to a frame 26. The vehicle 20 can include a steering wheel 28 that can facilitate pivoting of the front wheels 22 and/or the rear wheels 24 to steer the vehicle 20. The front and rear wheels 22, 24 can be associated with respective front and rear steering assemblies that facilitate turning of the front and rear wheels 22, 24 in response to operation of the steering wheel 28. An engine 30 can be coupled with a transmission (not shown) and can provide motive power to the transmission to facilitate driving of at least one of the front wheels 22 and/or at least one of the rear wheels 24.

Figure 2:
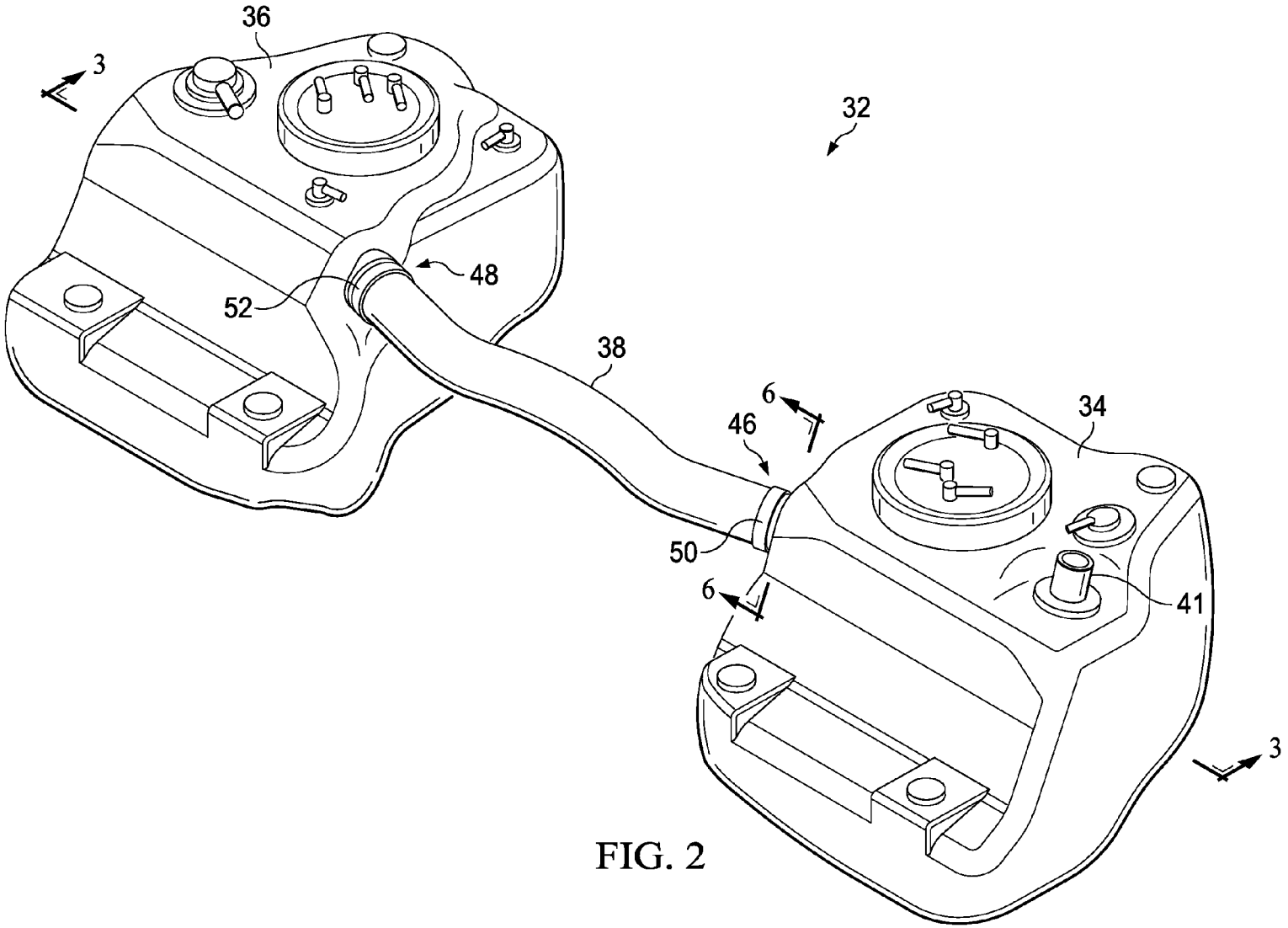
FIG. 2 is a front perspective view depicting a fuel tank assembly of the vehicle of FIG. 1.
Figure 3:
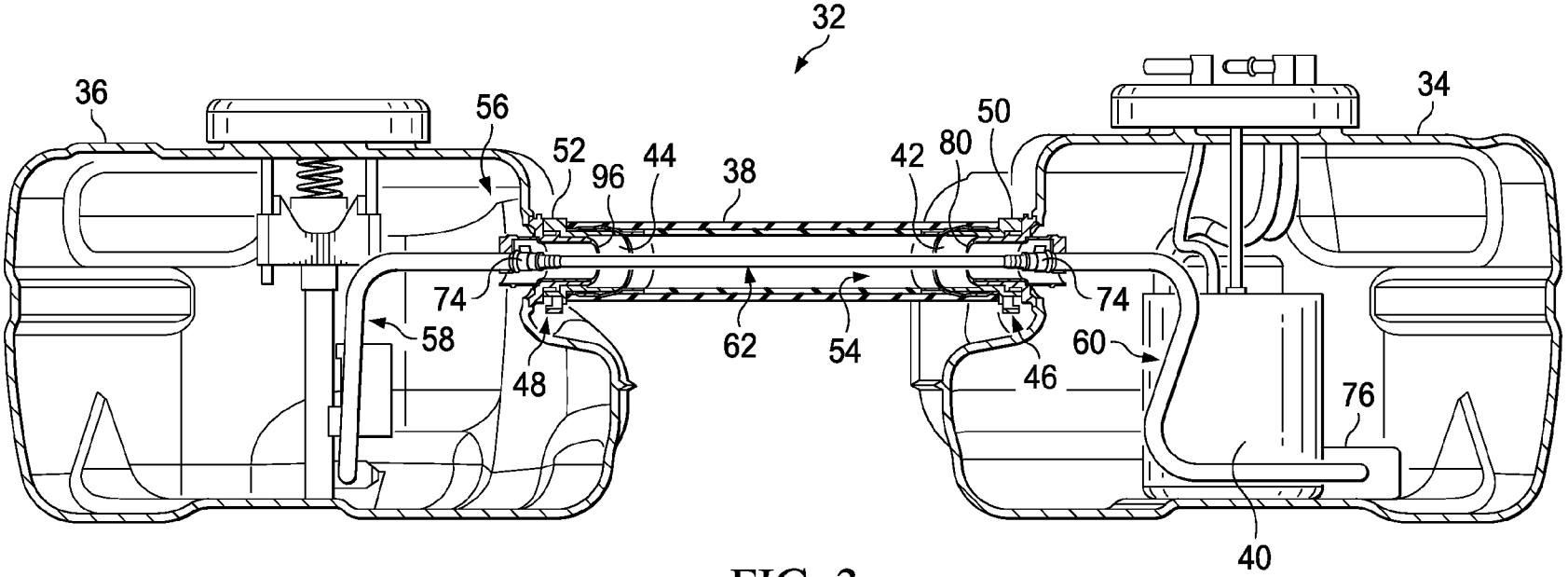
FIG. 3 is a cross-sectional view taken along the line 3-3 in FIG. 2.
Figure 4:
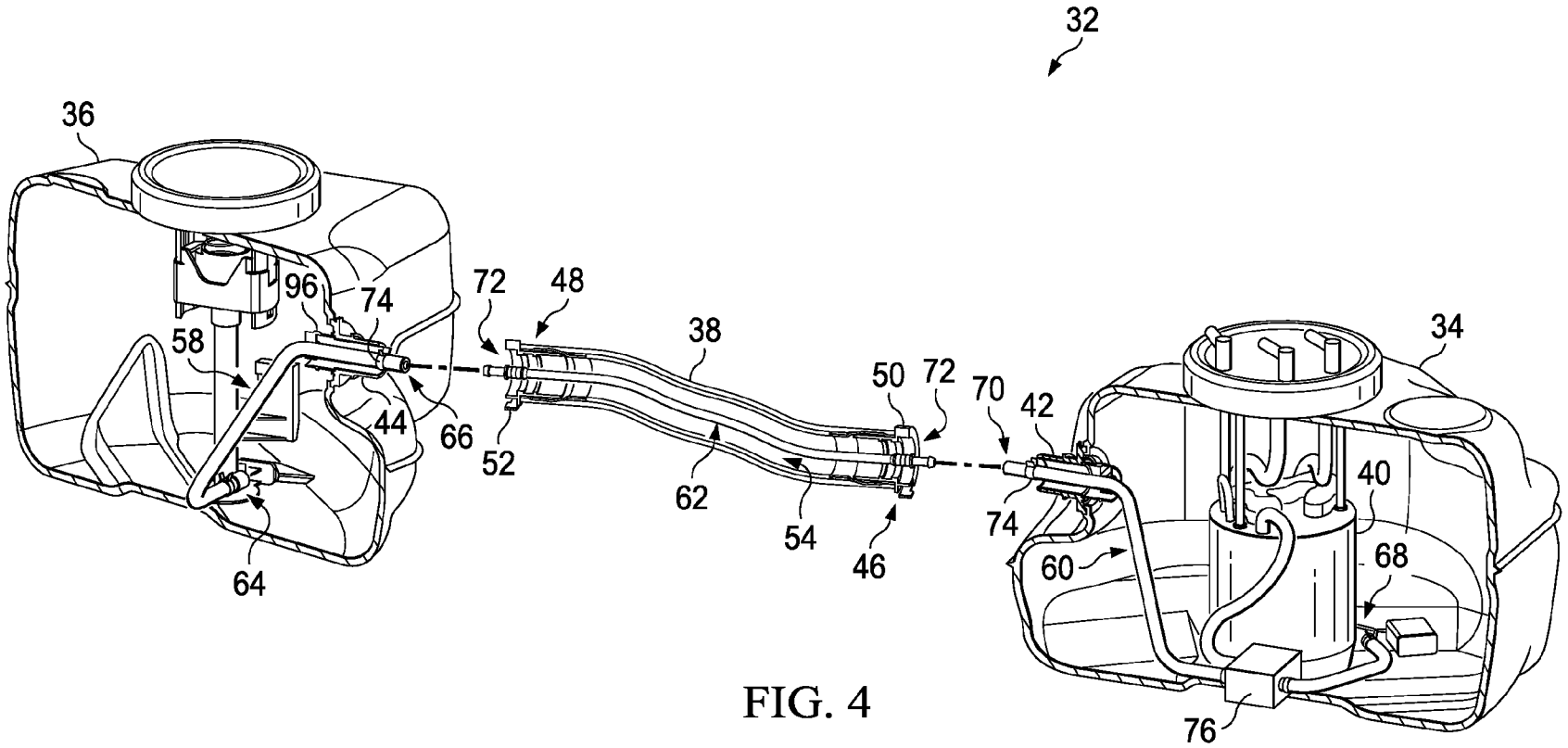
FIG. 4 is an exploded view of the cross-sectional view of the fuel tank assembly of FIG. 3.

As illustrated in FIGS. 2-4, the vehicle 20 can include a fuel tank assembly 32 that includes a primary fuel tank 34, a secondary fuel tank 36, and a crossover tube 38. A fuel pump 40 can be disposed within the primary fuel tank 34 and can be in fluid communication with the engine 30 (FIG. 1) and a jet pump 76. The fuel pump 40 can be configured to selectively supply fuel from the primary fuel tank 34 to the engine 30. In one embodiment, the fuel pump 40 can provide fuel to port fuel injectors of the engine 30. In another embodiment the fuel pump 40 can provide fuel to direct fuel injectors of the engine 30. In yet another embodiment, the fuel pump 40 can provide fuel to a carburetor of the engine 30. The primary fuel tank 34 can include a fill port 41 (FIG. 2) that facilitates filling of the primary fuel tank 34 with fuel. The fill port 41 can be coupled with a filler tube (not shown) that is configured to receive fuel from a fuel dispenser (e.g. at a filling station). In one embodiment, the primary fuel tank 34 can be disposed on a left side of the vehicle 20 and the secondary fuel tank 36 can be disposed on the right side of the vehicle 20.

The crossover tube 38 can be fluidly coupled with each of the primary and secondary fuel tanks 34, 36. In one embodiment, as illustrated in FIGS. 3 and 4, the primary and secondary fuel tanks 34, 36 can include respective crossover ports 42, 44. A primary end 46 of the crossover tube 38 can be coupled with the crossover port 42 of the primary fuel tank 34 and a secondary end 48 of the crossover tube 38 can be coupled with the crossover port 44 of the secondary fuel tank 36. In one embodiment, the primary and secondary ends 46, 48 of the crossover tube 38 can include respective couplings 50, 52. The couplings 50, 52 can be coupled with the respective crossover ports 42, 44, such as through a frictional coupling, so that an effective seal is created therebetween. In some embodiments, an O-ring (not shown) can be provided between each of the couplings 50, 52 and the respective crossover ports 42, 44. In some embodiments, each of the couplings 50, 52 can be secured to the respective crossover ports 42, 44 with a hose clamp (not shown).

The crossover tube 38 can define a flow path 54 (FIG. 3) that allows fuel to flow in both directions between the primary fuel tank 34 and the secondary fuel tank 36. For example, when the primary fuel tank 34 is being filled (e.g., through the fill port 41) and the fuel level within the primary fuel tank 34 reaches the crossover tube 38, fuel can flow through the flow path 54 to facilitate filling of the secondary fuel tank 36 with fuel. In another example, when the primary and secondary fuel tanks 34, 36 are filled to a level at or above the crossover tube 38, fuel can flow through the crossover tube 38 to maintain a substantially equal fuel level in each of the primary and secondary fuel tanks 34, 36. In one embodiment, the fuel can flow through the flow path 54 between the primary and secondary fuel tanks 34, 36 at a pressure that is about one atmosphere (e.g., the fuel through the flow path 54 is not externally pressurized, such as with a pump).

As illustrated in FIGS. 3 and 4, the fuel tank assembly 32 can include a transfer tube 56 that has an extracting portion 58, a dispensing portion 60, and a central portion 62. The extracting portion 58 can extend into the secondary fuel tank 36 such that a distal end 64 is disposed within, and is in fluid communication with, the secondary fuel tank 36. A proximal end 66 of the extracting portion 58 can extend into the crossover port 44 of the secondary fuel tank 36. The dispensing portion 60 can extend into the primary fuel tank 34 such that a distal end 68 is disposed within, and is in fluid communication with, the primary fuel tank 34. A proximal end 70 of the dispensing portion 60 can extend into the crossover port 42 of the primary fuel tank 34. The central portion 62 can be routed through (e.g., internal to) the crossover tube 38 and can be coupled with each of the extracting portion 58 and the dispensing portion 60 such that the extracting portion 58, the dispensing portion 60, and the central portion 62 are in fluid communication with each other.

Figure 5:
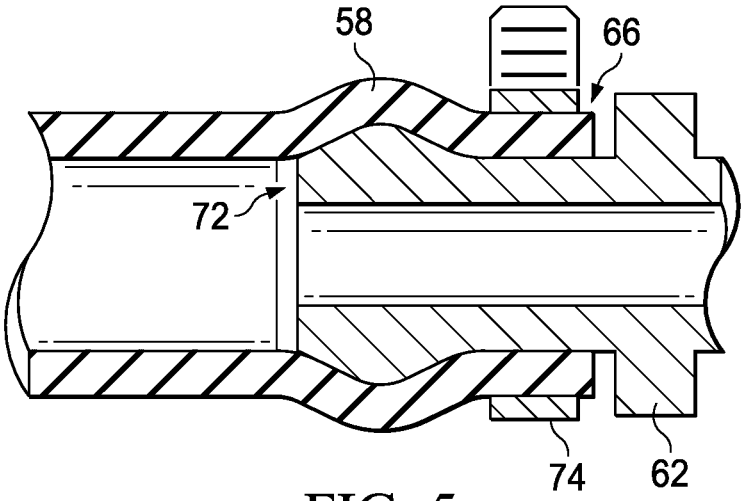
FIG. 5 is a cross-sectional view of the encircled area of FIG. 3 depicting a coupling arrangement according to one embodiment.

In one embodiment, as illustrated in FIG. 4, the central portion 62 can include a pair of barbed outer ends 72 that facilitate coupling of the central portion 62 with the extracting and dispensing portions 58, 60. The interaction between one of the barbed outer ends 72 and the dispensing portion 58 is shown in FIG. 5 and will now be discussed. As shown in FIG. 5, the barbed outer end 72 can project into the proximal ends 66 of the extracting portion 58 to facilitate releasable coupling of the central portion 62 to the extracting portion 58. A hose clamp 74 can be routed over the interaction between the barbed outer end 72 and the extracting portion 58 and can selectively clamp the proximal end 66 to the barbed outer end 72. The proximal end 70 of the dispensing portion 60 can be similarly releasably attached to the other barbed outer end 72.

It is to be appreciated that releasable coupling of the central portion 62 to the extracting portion 58 and the dispensing portion 60 can aid in the assembly and disassembly of the crossover tube 38 onto/from the primary and secondary fuel tanks 34, 36. It is also to be appreciated that in other embodiments, the extracting portion 58, the dispensing portion 60, and/or the central portion 62 of the transfer tube 56 can be coupled together using any of a variety of releasable or non-releasable fluid coupling arrangements, such as, for example, in a one-piece construction or rigidly fastened together (e.g., welded).

Figure 6:
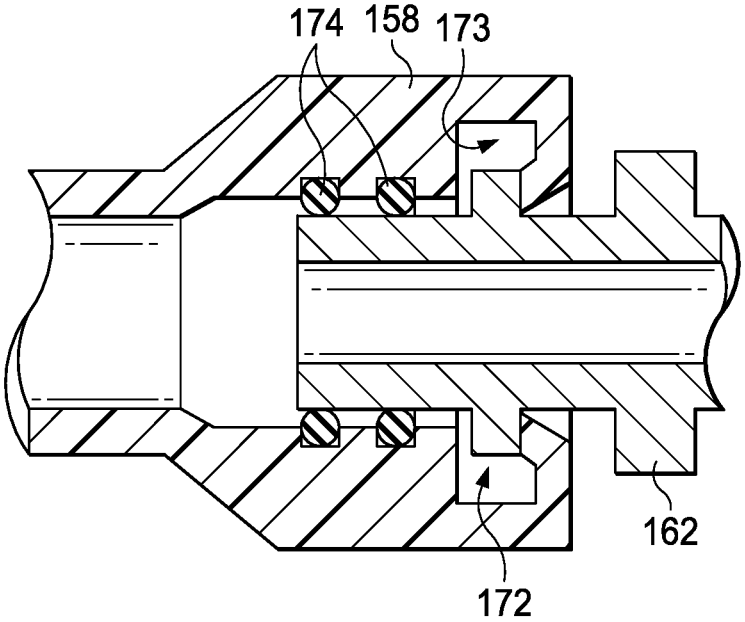
FIG. 6 is a cross-sectional view depicting a coupling arrangement according to another embodiment.

FIG. 6 illustrates an alternative bayonet-type coupling arrangement between extracting and central portions 158, 162 of a transfer tube 156. In such an embodiment, the central portion 162 can include a male end 172 and the extracting portion 162 can include a female slot 173. When the male end 172 is inserted into the extracting portion 158 and rotated, the male end 172 can interact with the female slot 173 to releasably couple the extracting and central portions 158, 162 together. A pair of O-rings 174 can be interposed between the extracting and central portions 158, 162 of the transfer tube 156.

Referring again to FIG. 4, a jet pump 76 can be in fluid communication with the dispensing portion 60 of the transfer tube 56. The jet pump 76 can be operable to facilitate pumping of fuel from the secondary fuel tank 36, into the extracting portion 58 of the transfer tube 56, through the central portion 62 of the transfer tube 56, out of the dispensing portion 60 of the transfer tube 56, and into the primary fuel tank 34. In one embodiment, the jet pump 76 can comprise a Venturi-type pump. In such an embodiment, fuel from the fuel pump 40 can be provided through the jet pump 76 which can create a vacuum in the transfer tube 58. As a result, the fuel provided through the transfer tube 56 can be pressurized by the jet pump 76 at a pressure that is greater (i.e., more negative) than the pressure of the fuel permitted to flow through the flow path 54 of the crossover tube 38 (e.g., a pressure greater than about one atmosphere). In one embodiment, the central portion 62 of the transfer tube 56 can provide the only path through the crossover tube 38 for fuel to flow from the secondary fuel tank 36 to the primary fuel tank 34 at a pressure greater than that of the fuel provided though the flow path 54 of the crossover tube 38. As such, the crossover tube 38 can be less complicated to install/remove than conventional arrangements having multiple transfer tubes routed through a crossover tube.

During operation of the engine 30, the fuel pump 40 can supply fuel to the engine 30 and the jet pump 76 from the primary fuel tank 34. The jet pump 76 can accordingly continuously provide fuel from the secondary fuel tank 36 (via the transfer tube 56) to the primary fuel tank 34 until the fuel in the secondary fuel tank 36 is completely depleted. Under certain vehicular conditions (e.g., idling), the flow rate of fuel to the engine 30 can be less than the flow rate of fuel through the transfer tube 56. During these conditions, when the fuel level in the primary fuel tank 34 is at the crossover tube 38, the fuel provided into the primary fuel tank 34 from the transfer tube 58 can overflow through the transfer tube 56 and back into the secondary fuel tank 36. During other vehicular conditions (e.g., highway travel), the flow rate of fuel to the engine 30 can be greater than the flow rate of fuel through the transfer tube 56. During these conditions, the primary fuel tank 34 can be depleted by the fuel pump 40 and the jet pump 76 can replenish the primary fuel tank 34 with fuel from the secondary fuel tank 36.

Although the jet pump 76 is shown to be disposed within the primary fuel tank 34 and fluidly coupled with the dispensing portion 60 of the transfer tube 56, in other embodiments, a jet pump can be provided in any of a variety of suitable locations, such as, for example, disposed within the secondary fuel tank 36 and fluidly coupled with the extracting portion 58 of the transfer tube 56 and/or disposed within the crossover tube 38 and fluidly coupled with the central portion 62 of the transfer tube 56. It is to be appreciated that although the jet pump 76 is described as a Venturi-type pump, any of a variety of suitable alternative jet pump arrangements are contemplated such as, for example, an electric pump.

Referring again to FIGS. 3 and 4, the fuel tank assembly 32 can include a support member 80 that is coupled with the crossover port 42 of the primary fuel tank 34. The support member 80 can extend into the crossover port 42 of the primary fuel tank 34. The proximal end 70 of the dispensing portion 60 of the transfer tube 56 can be routed through and coupled with the support member 80 such that the support member 80 supports the transfer tube 56 with respect to the crossover port 42. In one embodiment, the proximal end 70 of the dispensing portion 60 can be slidably coupled with the support member 80. As such, the proximal end 70 can be pulled away from the support member 80 slightly, as illustrated in FIG. 4, to allow for grasping of the proximal end 70 during installation/removal of the crossover tube 38 and the central portion 62 to/from the primary fuel tank 34.

Figure 7:
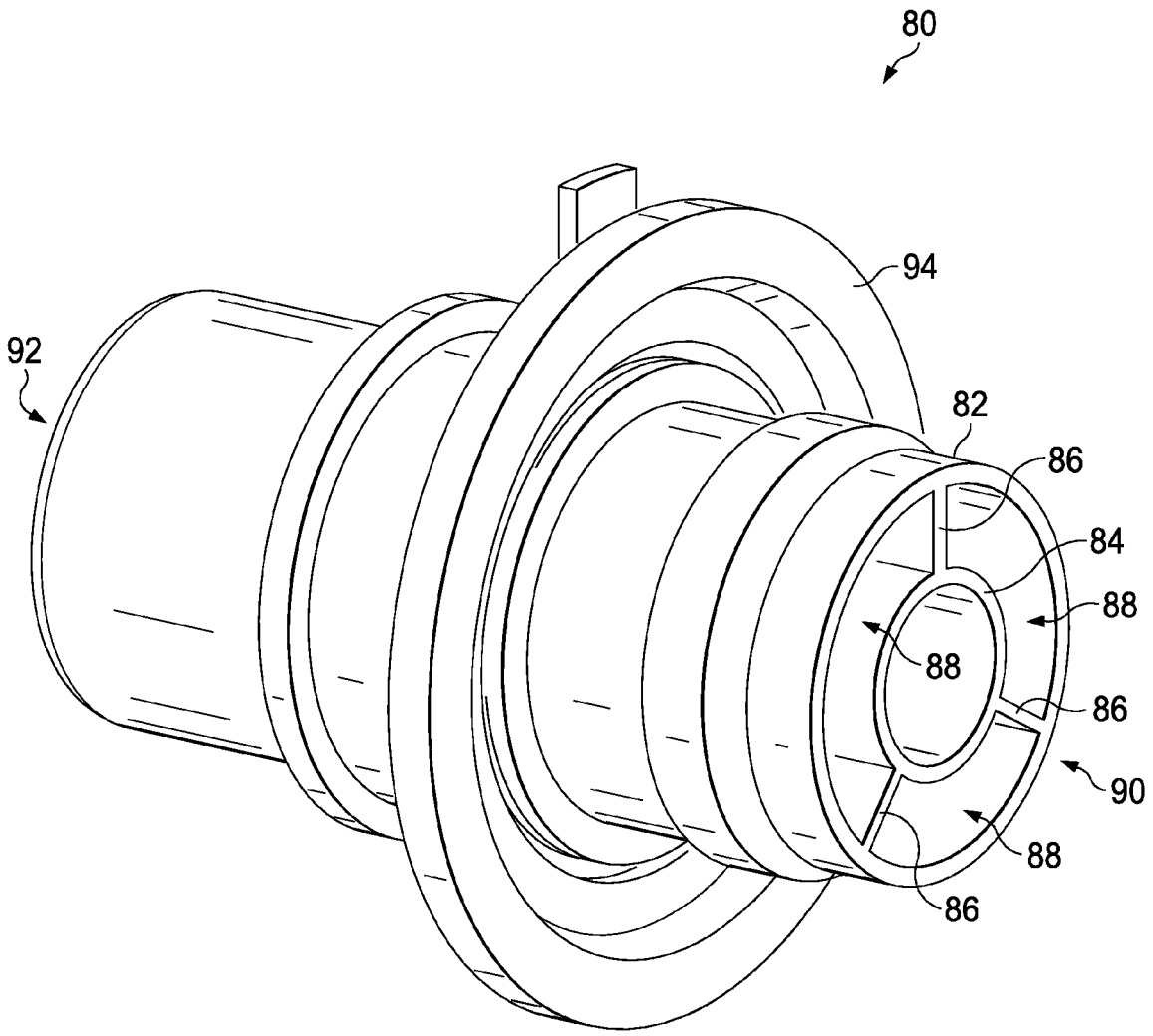
FIG. 7 is front perspective view depicting a support member of the fuel tank assembly of FIG. 2.

Referring now to FIG. 7, the support member 80 can include an outer wall 82, an interior collar 84, and a plurality of radial rib members 86 that couple the interior collar 84 to the outer wall 82. The interior collar 84 can accordingly be spaced from the outer wall 82 such that one or more annular passageways 88 are defined between the interior collar 84 and the outer wall 82. When the support member 80 is inserted into the crossover port 42 of the primary fuel tank 34, fuel flowing through the flow path 54 of the crossover tube 38 can also flow through the annular passageway 88. The dispensing portion 60 of the transfer tube 56 can be coupled with the interior collar 84 of the support member 80 such that the dispensing portion 60 is spaced from the outer wall 82 of the support member 80. In one embodiment, the support member 80 can position the dispensing portion 60 of the transfer tube 56 such that the dispensing portion 60 and the central portion 62 are substantially concentric with the crossover tube 38 at the primary end 46 of the crossover tube 38. It is to be appreciated that, although the outer wall 82 and the interior collar 84 are shown to be substantially annular shaped, an outer wall and/or an interior collar can be provided in any of a variety of suitable alternative shapes.

Still referring to FIG. 7, the support member 80 can include a front end 90 and a rear end 92. The outer wall 82, the interior collar 84, and the plurality of radial rib members 86 can be disposed at the front end 90. The rear end 92 can be shaped to engage the crossover port 42 when the support member 80 is inserted in the crossover port 42. The support member 80 can include a flange 94 that is disposed between the front end 90 and the rear end 92. When the support member 80 is inserted in the crossover port 42, the flange 94 can contact the portion of the primary fuel tank 34 that surrounds the crossover port 42 to create an effective seal therebetween. In one embodiment, the support member 80 can be welded to the crossover port 42.

Referring again to FIGS. 3 and 4, the fuel tank assembly 32 can include a support member 96 that is similar in many respects to the support member 80. However, the support member 96 can be coupled with the crossover port 44 of the secondary fuel tank 36 and the extracting end 58 of the transfer tube 56 such that the support member 96 supports the extracting portion 58 and the central member 62 with respect to the crossover port 44.

Figure 8:
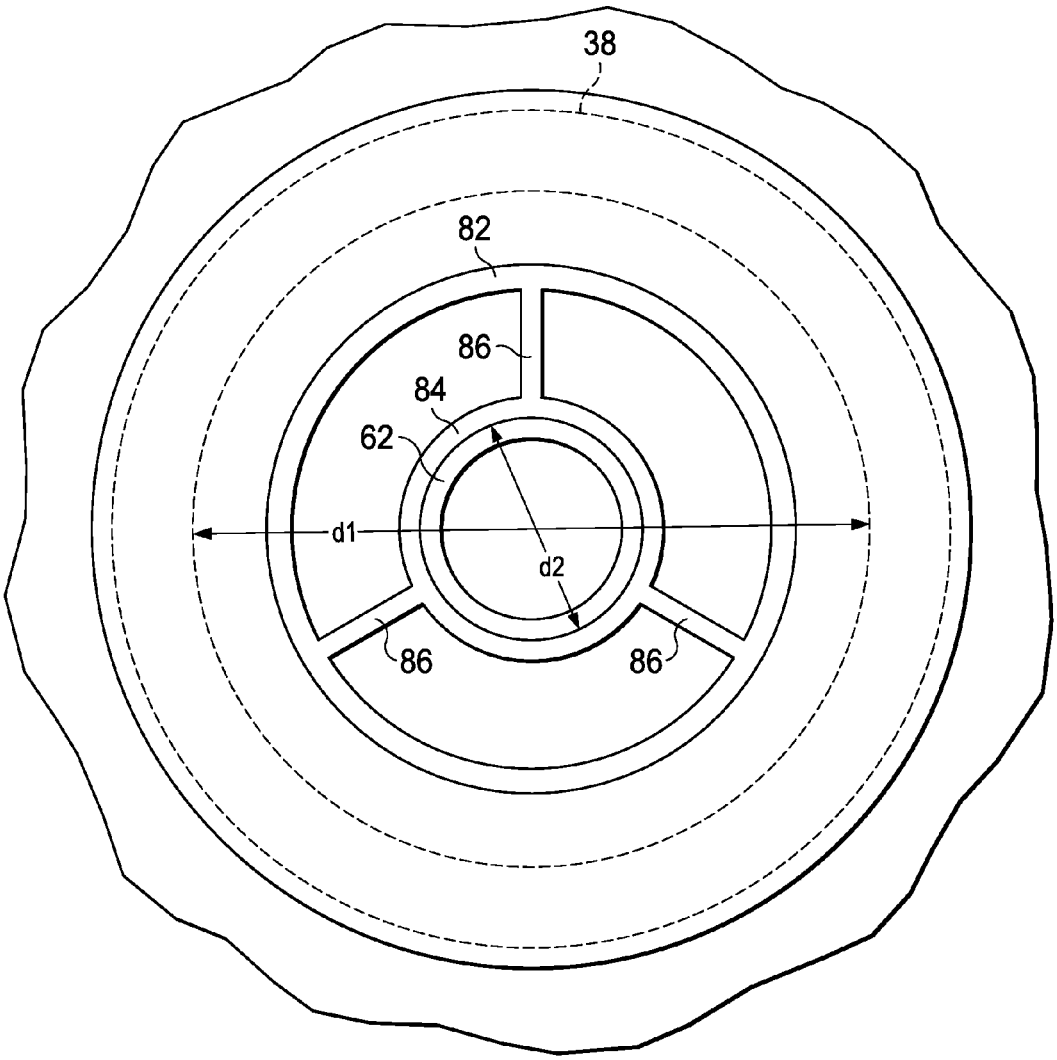
FIG. 8 is a cross-sectional view taken along the line 6-6 in FIG. 2.

Referring now to FIG. 8, the crossover tube 38 can have an inner diameter d1 and the central portion 62 of the transfer tube 56 can have an outer diameter d2. In one embodiment, the ratio of the inner diameter d1 of the crossover tube 38 to the outer diameter d2 of the central portion 62 of the transfer tube 56 can be between about 1.5:1 to about 4:1 and more particularly can be about 2:1.

The foregoing description of embodiments and examples of the invention has been presented for purposes of illustration and description. It is not intended to be exhaustive nor to limit the invention to the forms described. Numerous modifications are possible in light of the above teachings. Some of those modifications have been discussed and others will be understood by those skilled in the art. The embodiments were chosen and described in order to best illustrate the principles of the invention and various embodiments as are suited to the particular use contemplated. The scope of the invention is, of course, not limited to the examples or embodiments set forth herein, but can be employed in any number of applications and equivalent devices by those of ordinary skill in the art. Rather it is hereby intended the scope of the invention be defined by the claims appended hereto.

What is claimed is:

1. A vehicle comprising:

an engine;

a primary fuel tank;

a secondary fuel tank;

a crossover tube defining a passageway and having an inner diameter, the crossover tube being fluidly coupled with each of the primary fuel tank and the secondary fuel tank, wherein the crossover tube provides a flow path for fuel to flow between the primary fuel tank and the secondary fuel tank at a first pressure;

a fuel pump disposed within the primary fuel tank and in fluid communication with the engine for selectively supplying fuel from the primary fuel tank to the engine;

a transfer tube comprising an extracting portion, a dispensing portion, and a central portion in fluid communication with each of the extracting portion and the dispensing portion, the central portion having an outer diameter and being routed internal to the crossover tube; and a jet pump in fluid communication with the transfer tube, wherein:

an end of the extracting portion of the transfer tube is disposed in, and is in fluid communication with, the secondary fuel tank;

an end of the dispensing portion of the transfer tube is disposed in, and is in fluid communication with, the primary fuel tank;

the jet pump facilitates pumping of fuel from the secondary fuel tank, into the extracting portion, through the central portion, and out of the dispensing portion, and to the primary fuel tank;

the transfer tube provides an only path through the crossover tube for fuel to flow from the secondary fuel tank to the primary fuel tank at a pressure greater than the first pressure; and the crossover tube includes only the transfer tube.

2. The vehicle of claim 1 wherein the ratio of the inner diameter of the crossover tube to the outer diameter of the transfer tube is about 2:1.

3. The vehicle of claim 1 wherein the primary fuel tank comprises a first crossover port, the secondary fuel tank comprises a second crossover port, the crossover tube is coupled with each of the first crossover port and the second crossover port, and the transfer tube is routed through each of the first crossover port and the second crossover port.

4. The vehicle of claim 3 further comprising:

a first support member coupled with the first crossover port; and a second support member coupled with the second crossover port;

wherein the transfer tube is coupled with each of the first support member and the second support member.

5. The vehicle of claim 4 wherein the transfer tube is slidably coupled with the first support member and the second support member.

6. The vehicle of claim 4 wherein the first support member and the second support member each comprise:

an outer wall; and an interior collar coupled with the outer wall and spaced from the outer wall such that an annular passageway is defined between the interior collar and the outer wall; and wherein the transfer tube is coupled with the respective interior collars of the first support member and the second support member such that the transfer tube is spaced from the respective outer walls of the first support member and the second support member.

7. The vehicle of claim 6 wherein the first support member and the second support member each further comprise a plurality of radial rib members that couple the interior collar to the outer wall.

8. The vehicle of claim 6 wherein the inner wall and the outer wall are annularly-shaped.

9. The vehicle of claim 6 wherein the dispensing portion of the transfer tube is coupled with the interior collar of the first support member and the extracting portion of the transfer tube is coupled with the interior collar of the second support member.

10. The vehicle of claim 1 wherein the jet pump is disposed in the primary fuel tank and is fluidly coupled with the dispensing portion of the transfer tube.

11. A fuel tank assembly comprising:

a primary fuel tank;

a secondary fuel tank;

a crossover tube fluidly coupled with each of the primary fuel tank and the secondary fuel tank and defining a flow path for fuel to flow between the primary fuel tank and the secondary fuel tank at a first pressure;

a fuel pump disposed within the primary fuel tank and configured to selectively supply fuel from the primary fuel tank to an engine;

a transfer tube routed internal to the crossover tube and in fluid communication with each of the primary fuel tank and the secondary fuel tank; and a jet pump in fluid communication with the transfer tube and configured to facilitate the flow of pressurized fuel at a second pressure from the secondary fuel tank, through the transfer tube, and into the primary fuel tank, wherein:

the second pressure is greater than the first pressure; and the transfer tube provides the only path through the crossover tube for fuel to flow from the secondary fuel tank to the primary fuel tank at a pressure greater than the first pressure.

12. The fuel tank assembly of claim 11 wherein:

the crossover tube has an inner diameter;

the transfer tube further comprises an extracting portion, a dispensing portion, and a central portion in fluid communication with each of the extracting portion and the dispensing portion;

the central portion of the transfer tube has an outer diameter;

an end of the extracting portion of the transfer tube is disposed in, and is in fluid communication with, the secondary fuel tank;

an end of the dispensing portion of the transfer tube is disposed in, and is in fluid communication with, the primary fuel tank; and the central portion of the transfer tube and the crossover tube are substantially concentric at one end of the crossover tube.

13. The fuel tank assembly of claim 12 wherein the ratio of the inner diameter of the crossover tube to the outer diameter of the transfer tube is about 2:1.

14. The fuel tank assembly of claim 11 wherein the primary fuel tank includes a first crossover port, the secondary fuel tank includes a second crossover port, the crossover tube is coupled with each of the first crossover port and the second crossover port, and the transfer tube is routed through each of the first crossover port and the second crossover port.

15. The fuel tank assembly of claim 14 further comprising:

a first support member coupled with the first crossover port; and a second support member coupled with the second crossover port;

wherein the transfer tube is coupled with each of the first support member and the second support member.

16. The fuel tank assembly of claim 15 wherein the transfer tube is slidably coupled with the first support member and the second support member.

17. The fuel tank assembly of claim 15 wherein the first support member and the second support member each comprise:

an outer wall; and an interior collar coupled with the outer wall and spaced from the outer wall such that an annular passageway is defined between the interior collar and the outer wall; and wherein the transfer tube is coupled with the respective interior collars of the first support member and the second support member such that the transfer tube is spaced from the respective outer walls of the first support member and the second support member.

18. The fuel tank assembly of claim 17 wherein the first support member and the second support member each further comprise a plurality of radial rib members that couple the interior collar to the outer wall.

19. The fuel tank assembly of claim 18 wherein the dispensing portion of the transfer tube is coupled with the interior collar of the first support member and the extracting portion of the transfer tube is coupled with the interior collar of the second support member.

20. A vehicle comprising:

an engine;

a primary fuel tank;

a secondary fuel tank;

a crossover tube fluidly coupled with each of the primary fuel tank and the secondary fuel tank and defining a flow path for fuel to flow between the primary fuel tank and the secondary fuel tank at a first pressure;

a fuel pump disposed within the primary fuel tank and configured to selectively supply fuel from the primary fuel tank to the engine;

a transfer tube routed internal to the crossover tube and in fluid communication with each of the primary fuel tank and the secondary fuel tank; and a jet pump in fluid communication with the transfer tube and configured to facilitate the flow of pressurized fuel at a second pressure from the secondary fuel tank, through the transfer tube, and into the primary fuel tank, wherein:

the second pressure is greater than the first pressure; and the transfer tube provides the only path through the crossover tube for fuel to flow from the secondary fuel tank to the primary fuel tank at a pressure greater than the first pressure.

* * * * *